United States Patent [19]

LoTurco

[11] Patent Number: 4,768,242

[45] Date of Patent: Sep. 6, 1988

[54] BED ASSEMBLY

[76] Inventor: Raymond A. LoTurco, 11506 W. Youth Camp Rd., Columbus, Ind. 47201

[21] Appl. No.: 928,810

[22] Filed: Nov. 10, 1986

[51] Int. Cl.[4] ..... A47D 7/02; A47D 7/03

[52] U.S. Cl. ..... 5/93 R; 5/11; 5/63; 5/100

[58] Field of Search ..... 5/93 R, 100, 11, 63, 5/65, 425, 428

[56] References Cited

U.S. PATENT DOCUMENTS

| | | | |
|---|---|---|---|
| 685,448 | 10/1901 | Jacobs | 5/425 |
| 1,043,701 | 11/1912 | Hornsby | 5/100 |
| 1,875,435 | 9/1932 | Franzen | 5/11 X |
| 2,504,324 | 4/1950 | Goldstein | 5/100 |
| 2,729,875 | 1/1956 | White | 5/11 X |
| 2,765,477 | 10/1956 | Royce | 5/100 X |
| 2,840,831 | 7/1958 | Kedrowski | 5/100 X |
| 2,873,455 | 2/1959 | Davis | 5/63 |
| 2,968,817 | 1/1961 | Jacobs et al. | 5/11 X |
| 3,045,259 | 7/1962 | Mayer | 5/100 X |
| 3,535,717 | 10/1970 | Mulder | 5/93 R |
| 3,541,619 | 11/1970 | Morrison | 5/11 X |
| 4,451,945 | 6/1984 | Heinz et al. | 5/11 X |

FOREIGN PATENT DOCUMENTS

| | | | |
|---|---|---|---|
| 1176846 | 4/1959 | France | 5/100 |
| 352343 | 7/1931 | United Kingdom | 5/100 |
| 1279081 | 6/1972 | United Kingdom | 5/100 R |
| 1464573 | 2/1977 | United Kingdom | 5/66 |

*Primary Examiner*—Alexander Grosz

*Attorney, Agent, or Firm*—Woodard, Emhardt, Naughton, Moriarty & McNett

[57] ABSTRACT

Described briefly, according to a typical embodiment of the invention, a floor-mounted stationary base frame supports two traveling frames. One of the traveling frames comprises the mattress support frame. The other comprises the side and end walls of a single enclosure surrounding the mattress. Scissors arrangements connect the traveling frames to the base frame whereby the traveling frames are simultaneously operable in opposite directions to raise the mattress while the enclosure is lowered. A brake apparatus permits frame travel only during conscious and controlled operation of a brake release handle.

3 Claims, 4 Drawing Sheets

BED ASSEMBLY

BACKGROUND OF THE INVENTION

This invention relates generally to beds, and more particularly to an infant's crib.

DESCRIPTION OF THE PRIOR ART:

One of the most widely used types of infant crib is that which has wood paneled ends with two legs each, and wood side walls of a vertically slatted construction. One or both of the sides can be lowered for convenient access to the child in the crib. The mattress support is typically mounted on brackets on the ends of the bed. Means are provided to enable attachment of the mattress support at lower levels on the ends, to lower the mattress from time-to-time as the child grows. A crib having some similar features but later convertible to a play pen is shown in U.S. Pat. No. 3,535,717 to Mulder.

Some other patents having overall external appearances similar to that described above are as follows:

| Patent No. | Inventor |
|---|---|
| 2,968,817 | Jacobs et al. |
| 2,873,455 | Davis |
| 2,765,477 | Royce |
| 2,734,200 | Kedrowski |

In the Jacobs et al. patent, the sides and ends are permanently fixed together. A handle and/or foot-operated treadle 48 is provided in cooperation with a scissor linkage 30, 32 to raise and lower the auxiliary frame 24 which supports the mattress. In the Davis patent, a handle G is used to operate a shaft 16 interconnected by a toggle mechanism with the mattress support frame to raise and lower the mattress. The toggles move into position for automatically holding the mattress frame in raised position.

In both the Royce and Kedrowski patents, at least one side of the bed can be lowered. In the Royce patent, an arrangement of cables, links and a scissors mechanism are used to raise the mattress support frame 56. In Kedrowski, a different type of linkage is used to raise the mattress supporting crib bottom when the side 28 is lowered. The side 30 is independent of the bottom-operating mechanism and apparently was intended to be used when the baby crib was used with an older child and there was no necessity for raising the bottom.

There are times when, due to the position of the child, and even with the side of the crib lowered and the mattress raised, it is difficult to satisfactorily observe the child or obtain convenient access to the child, for lifting from the crib. Also, it is desirable to minimize the chance that any limb of the child can get caught in any of the mechanism, and it is desirable to eliminate the chance that the child can actuate the side dropping or mattress moving mechanism. The present invention addresses these points.

SUMMARY OF THE INVENTION

Described briefly, according to a typical embodiment of the invention, a floor-mounted stationary base frame supports two traveling frames. One of the traveling frames comprises the mattress support frame. The other comprises side and end walls surrounding the mattress. Scissors arrangements connect the traveling frames to the base frame whereby the traveling frames are simultaneously operable in opposite directions to raise the mattress while the surrounding walls arr lowered. A brake apparatus permits frame travel only during conscious and controlled operation of a brake release handle.

DESCRIPTION OF THE PREFERRED EMBODIMENT

Figure 1:
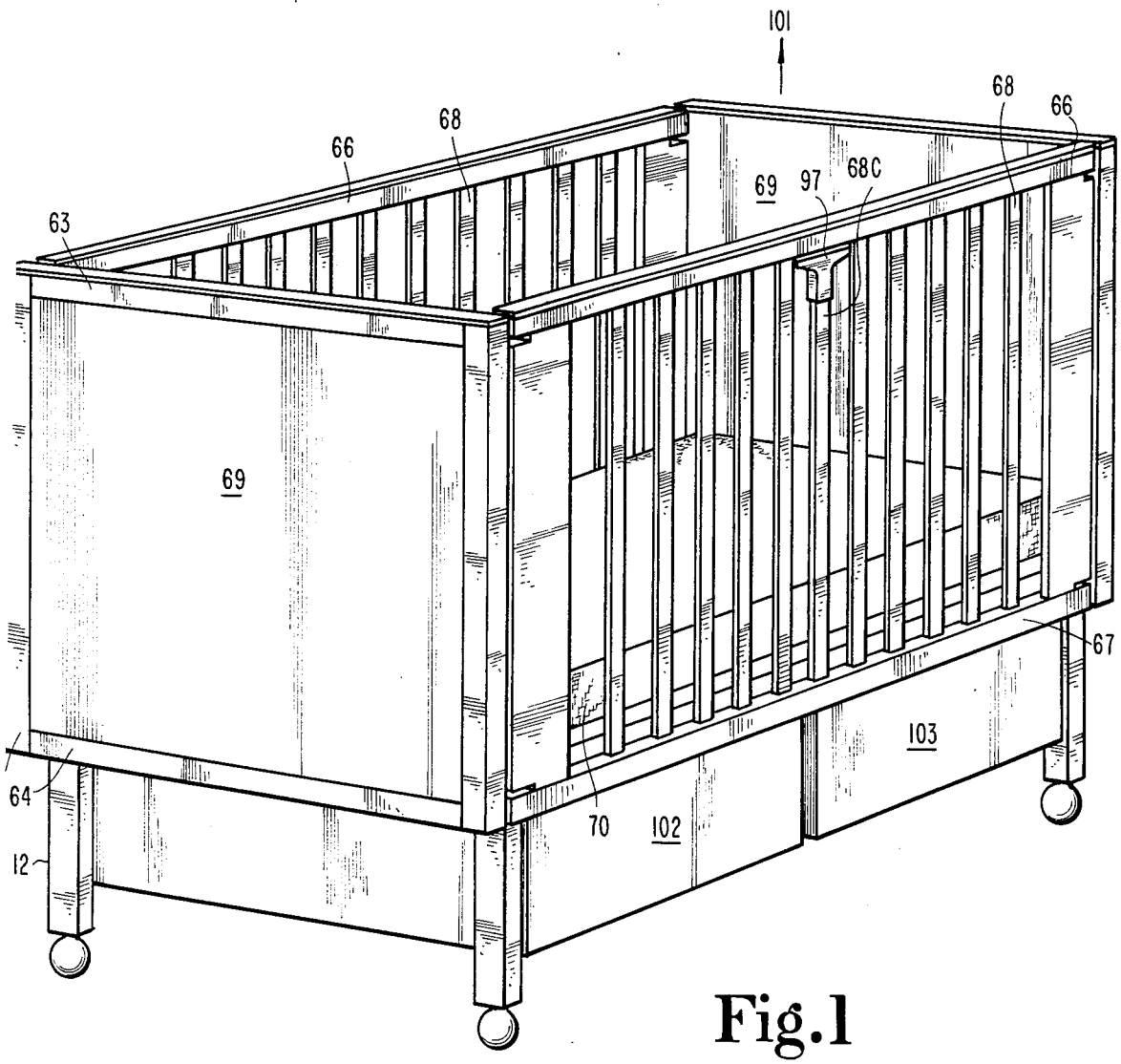
FIG. 1 is a pictorial view of a bed according to a typical embodiment of the present invention.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the bed 11 includes four legs 12 on casters 13. An end frame member 14 is attached to each of two legs by two bolts 16 at each end of each member 14. A center frame member 17 is attached to the center of each of the two end members 14 by rivets 18. Member 17 is a channel section steel with end tabs folded and apertures to receive the rivets 18. A nominal overall length may be fifty inches, depending on the desired overall length of the bed. The end frame members 14 are made in the same way to receive the bolts 16 to which nuts (not shown) are attached at the inner end. Four braces 19 of the same type of construction, except that the end tabs are not welded to the top and bottom flanges, are bolted into the corners of the end members 14. There they are bolted to the legs, using the same bolts 16 to bolt together the leg 12, one end of frame end 14, and the end of one brace 19. The inner end tab such as 19A, for each of the braces 19, is bolted or riveted to the web of the center frame 17. Thus, a rigid, floor-mounted base frame is assembled.

Figure 2:
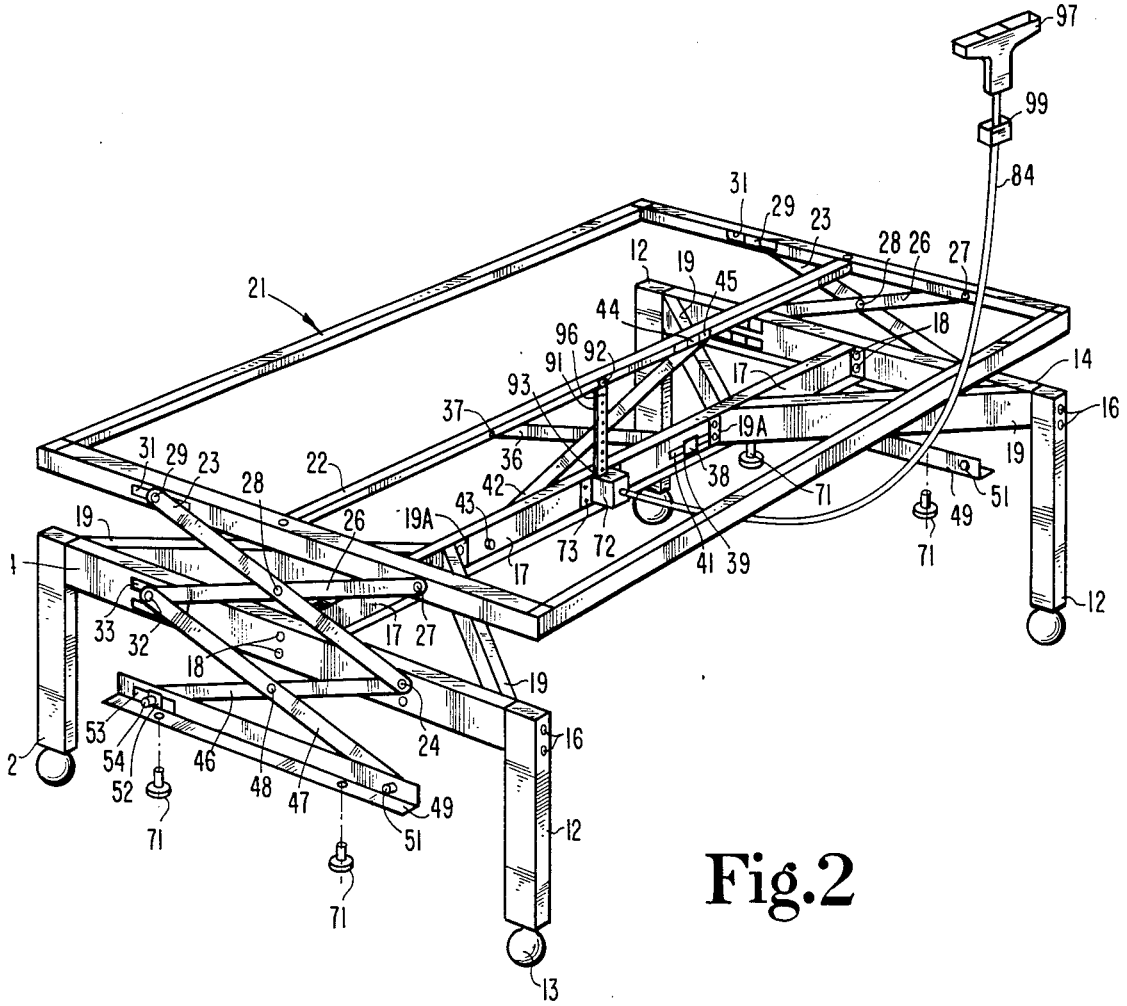
FIG. 2 is a pictorial view of the frame assembly with the vertical walls omitted to show interior details.
Figure 3:
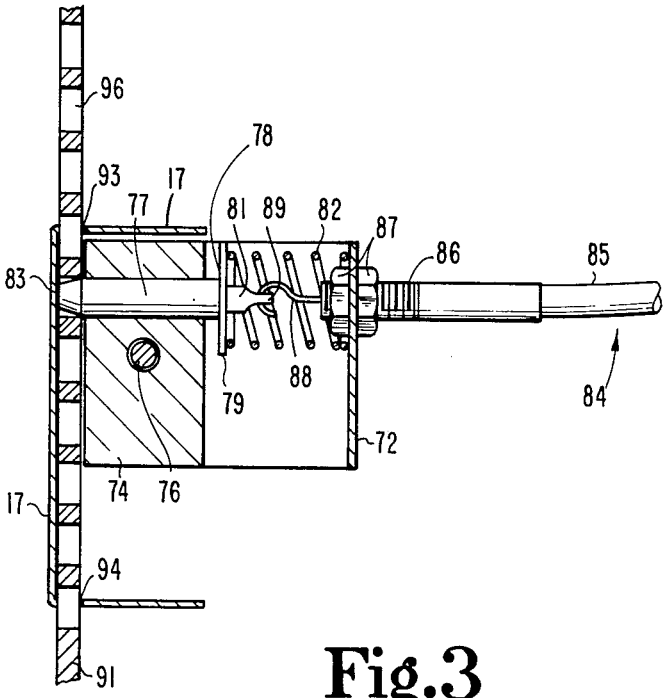
FIG. 3 is an enlarged sectional view through the brake assembly.
Figures 4, 5, 6:
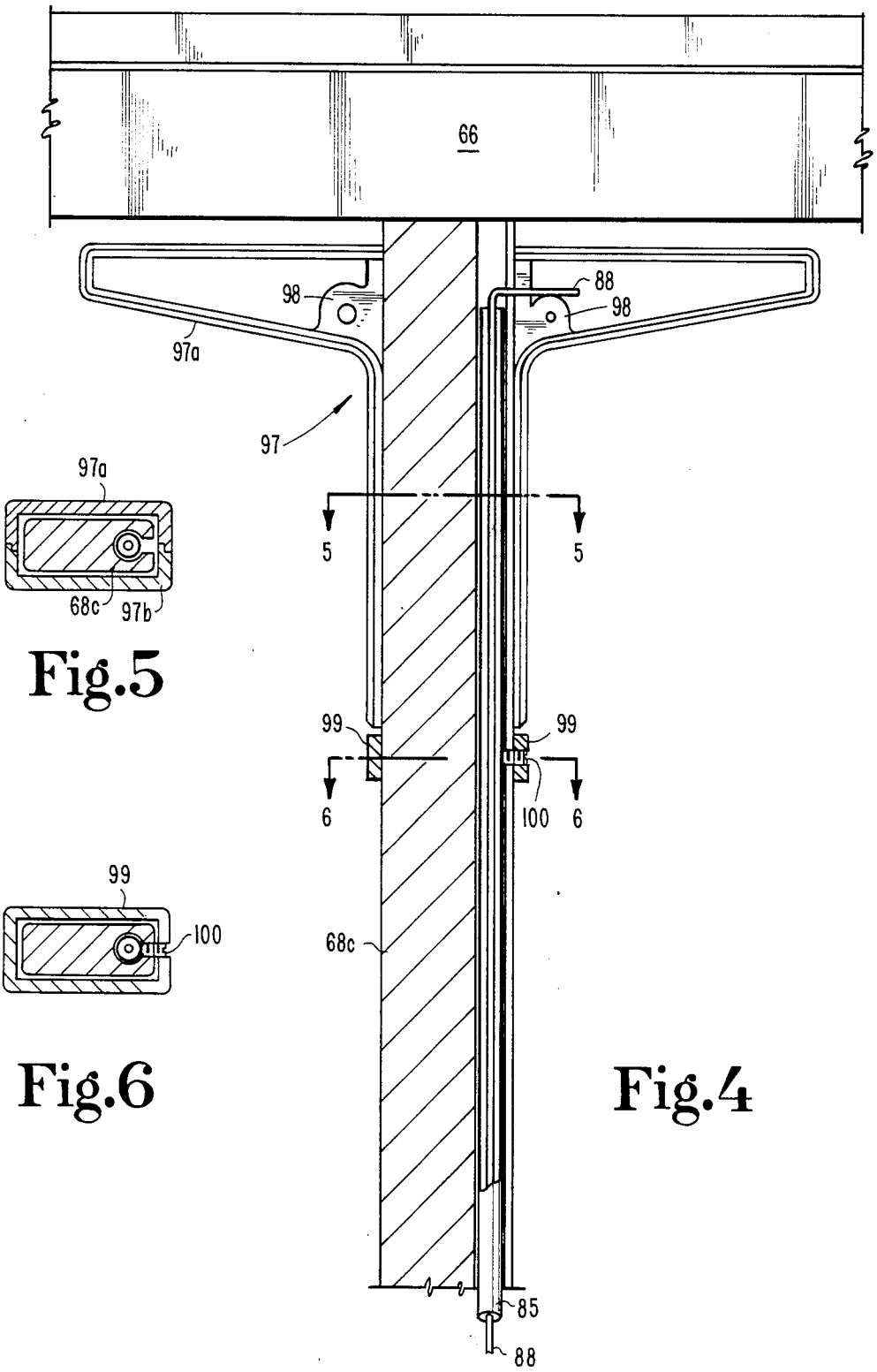
FIG. 4 is an enlarged sectional view through a portion of a slat and the brake operating handle.
FIG. 5 is a cross sectional view through the handle taken at line 5—5 in FIG. 4 and viewed in the direction of the arrows.
FIG. 6 is a cross sectional view through the cable anchor clamp assembly taken at line 6—6 in FIG. 4 and viewed in the direction of the arrows.

A mattress support frame assembly 21 is provided. It is a framework of steel box-sections with a center rail 22. This is mounted to the base frame end members by the upper halves of two double scissor lift assemblies The construction of the scissor lift assembly at each end is identical, so that shown at the near end in FIG. 2 will be described in detail. It includes arm 23 pinned to member 14 at pivot pin 24, the arm 26 pinned to the end member of frame 21 at pin 27, the arms 23 and 26 being pinned together at 28. Arm 23 is pinned at 29 to a glide in slot 31 in the mattress support frame 21. Arm 26 is pinned at 32 to a glide in slot 33 in member 14. These scissor arrangements will maintain the horizontal attitude of the ends of frame 21 as the frame is raised and lowered.

In order to maintain the horizontal attitude of the long sides of the frame, an additional scissors is provided at the center. It includes arm 36 pinned to rail 22 at 37 and pinned at 38 to a slide 39 in slot 41 in the center frame member 17. It also includes the arm 42 pinned to member 17 at 43 and pinned to a slide 44 in slot 45 in center rail 22, the arms 36 and 42 being pinned together at their intersection.

The lower halves of the double scissor assemblies at the opposite ends include arm 46 pinned to member 14 at 24, arm 47 pinned to arm 46 at 48 and to pin 32 on a slide in slot 33. A connector plate 49 is pinned to arm 47 at 51 and receives slide 52 in slot 53, the slide being pinned at 54 to the arm 46. An identical connector plate 49 is mounted at the oppoite end in exactly the same way. Thus, the double scissor mechanisms at the opposite ends of the bed are essentially identical.

An enclosure assembly 61 includes corner posts 62, upper and lower end rails 63 and 64, upper and lower side rails 66 and 67, side slats 68 and end panels 69. All of these parts are affixed together and provide a frame surrounding the mattress 70 closely enough to lightly touch any linens such as sheets on all four sides of the mattress. The lower end rails 64 are received on and fastened to the connector plates 49 by screws 71.

A brake assembly includes a housing 72 having flanges 73 fastened to the web of the base frame center member 17 by means of four rivets. A nylon guide block 74 is mounted in the housing 72 by a screw 76 through the housing and block. This block slidingly receives the lock pin 77 therein. The pin has a shoulder 78 which receives a spring seat washer 79 which pilots on the connector stem 81 of the pin. Return spring 82 seats at one end against washer 79 and at the other end against the housing. It urges the lock pin 77 to the left, where the end 83 of the pin abuttingly engages and stops against the web of the center frame member 17.

The brake housing 72 serves as a mount for the brake operating cable assembly 84 which has a sleeve 85 with threaded end portion 86 received through an aperture in the housing 72 and positioned by two nuts 87 jammed against opposite faces of the housing. The brake operating wire 88 extending lengthwise through the cable assembly, is hooked through an aperture at 89 in the stem 81 of the lock pin.

A bar 91 pinned at 92 to the center rail 22 of the mattress support frame, is received through slots 93 and 94 in the upper and lower flanges, respectively, of the base frame center member 17. Thus, the bar is vertically slidable therein. The bar has a plurality of apertures 96 in it. The tapered end of the lock pin 77 is receivable in any one of the many apertures. In a bar that is 7.5 inches long, there may be fifteen or more such apertures, depending upon the overall vertical travel distance desired for the mattress support frame assembly, and depending upon the precision of height adjustment which is desired.

The brake operating handle 97 comprises two identical shells **97*a* and 97*b* match fitted and connected together around the slat 68c by fasteners at the locations of the internal bosses 98. The brake cable sleeve 85 is received in the longitudinally extending groove in the slat 68*c*. The upper end of the brake cable sleeve is anchored in the groove by the set screw 100 threaded into the clamp ring 99 encircling the slat 68*c*. The upper end of the brake operating wire 88 is anchored in the handle over the boss 98 so that the wire is pulled upward when the handle is pulled upward toward the bottom of the rail 66. The strength of the spring 82 is great enough that, in order for the handle to be pulled upward in the direction of arrow 101 in FIG. 1, to pull the pin out of the bar 91 and release the brake, an adult would need to grip the upper rail 66 and both arms of the handle 97** to release the brake. This provides ample security against a child in the bed releasing the brake.

In the operation of the bed, the handle is pulled upward to release the brake, and then the enclosure assembly is pushed downward which thereby raises the mattress support frame and thereby the child. The handle can be released to enable the lock pin to enter a detent aperture and set the bräke whenever the optimum combination of height of enclosure assembly and mattress are achieved for access to the child. Such access can be equally achieved from any of the four sides of the bed. After attention to the child, the handle is again pulled upward to release the brake, the enclosure raised to the desired height, and handle released to set the brake.

Drawers 102 and 103 can be mounted to the base frame, if desired, for convenient storage of linens, diapers and the like, but must be located within the area circumscribed by the mattress enclosure assembly when it is lowered.

Various materials can be used in construction of a bed assembly incorporating the present invention. If it is desired to maintain a wood bed tradition, the sides and ends of the enclosure can be wood, with the ends paneled and the sides slatted, if desired. The base frame and mattress support frame and scissors mechanisms are likely to be made of steel. The slides or glides are likely to be made of plastic such as nylon, for example. The brake release handle may be made of injection molded styrene, for example.

The overall dimensions can be chosen to best meet the needs of the market. Examples are: overall length, 53½ inches; overall width, 29½ inches; overall height, 42 inches; enclosure wall height, 28 inches; vertical travel of enclosure and mattress, 6 inches each (12 inches relative to each other).

The optimum combination of materials, including bedding (bed spring system on mattress support frame, and mattress) plus a load of ten pounds on the mattress, would precisely balance the weight of the enclosure frame, so that, when the bed is occupied by a child weighing ten pounds, and the brake is released, the enclosure would neither tend to fall or rise from any position. However, as the child occupying the bed grows and gets heavier, it may be desirable to add assist spring means between the center frame member of the base frame, and the center member 22 of the mattress support frame, so that the person attending the child need not lean downwardly very hard on the enclosure to raise the mattress support frame with the child on it. In lieu of spring assist means, some weights could be hung on the enclosure frame. Because of the combination of the present invention, it is not likely that much, if any, of this type of attention will be needed, because the forces involved are relatively small, and much less than is ordinarily involved in lifting and carrying the child anyway.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A bed assembly comprising:

a base;

a mattress support frame;

a mattress enclosure frame;

a mechanism mounted on said base and connected to said frames and operable to move the mattress support frame in simultaneous cooperation with said enclosure frame but in the opposite direction;

said mechanism including scissor assemblies at opposite ends of said frames, each scissor assembly including an upper pair of arms and a lower pair of arms, the upper pair including a first arm having one end pivotally attached to said base and another end slidably connected to said mattress support frame, the upper pair including a second arm having one end pivotally attached to said mattress support frame and another end slidably connected to said base, the first and second arms being pivotally connected together, the lower pair including a third arm having one end pivotally attached to said base and another end slidably connected to said mattress enclosure frame, the lower pair including a fourth arm having one end pivotally attached to said mattress enclosure frame and another end slidably connected to said base, said third and fourth arms being pivotally connected together.

2. The assembly of claim 1 wherein:

said pivotal attachments to said base and to said mattress support frame and to said mattress enclosure frame are substantially vertically aligned.

3. The assembly of claim 1 wherein said scissor assemblies at opposite ends of said frames lie in parallel vertical planes, the assembly further comprising:

a further scissor assembly on said base and lying in a vertical plane perpendicular to the plane of the first mentioned scissor assemblies, said further scissor assembly having a first arm 36 having one end pivotally attached to said mattress support assembly and having another end slidably connected to said base, said further scissor assembly having a second arm pivotally attached to said base and slidably connected to said mattress support assembly, said first and second arms of said further scissor assembly being pivotally connected to each other.

* * * * *